US006296003B1

(12) United States Patent
Howe et al.

(10) Patent No.: US 6,296,003 B1
(45) Date of Patent: Oct. 2, 2001

(54) VERSATILE TENT DOOR

(75) Inventors: Robert Howe, Bend, OR (US); Theodore Ganio, Pleasant Hill, CA (US)

(73) Assignee: Sierra Designs, Inc., Emeryville, CA (US)

( * ) Notice: Subject to any disclaimer, the term of this patent is extended or adjusted under 35 U.S.C. 154(b) by 0 days.

(21) Appl. No.: 09/638,379

(22) Filed: Aug. 12, 2000

(51) Int. Cl.[7] ..... E04H 15/58

(52) U.S. Cl. ..... 135/117; 160/DIG. 18; 160/180; 135/93

(58) Field of Search ..... 135/117, 93; 160/180, 160/DIG. 18, 353, 354

(56) References Cited

U.S. PATENT DOCUMENTS 2,391,871 * 1/1946 Benson ..... 135/117 X
3,960,195 * 6/1976 Marchbanks ..... 160/DIG. 18
4,131,150 * 12/1978 Papadakis ..... 160/368.1
4,220,298 * 9/1980 Willis ..... 160/DIG. 18
5,394,897 * 3/1995 Ritchey et al. ..... 135/124
5,765,584 * 6/1998 Heisler et al. ..... 135/117 X
5,819,474 * 10/1998 Strom .

* cited by examiner

*Primary Examiner*—Robert Canfield
(74) *Attorney, Agent, or Firm*—Malcolm B. Wittenberg

(57) ABSTRACT

A tent having a fabric body defining an internal volume and a door for entering and exiting the internal volume and for providing ventilation to the internal volume. A continuous zipper is located on the periphery of the door and on the door opening. A pair of zipper slides is configured for traversing the continuous zipper enabling the door to completely open, completely close and open partially in any one of a number of orientations.

3 Claims, 2 Drawing Sheets

VERSATILE TENT DOOR

TECHNICAL FIELD OF INVENTION

The present invention is directed to a structure which is provided with an opening and a closable door. More specifically, the present invention is most appropriately applied to a tent having a fabric body. By employing the appropriate continuous zipper arrangement together with a pair of zipper slides, the door can be completely closed, completely open or partially opened in a number of various configurations.

BACKGROUND OF THE INVENTION

Fabric tents are generally provided with an open doorway and a side wall whereupon a fabric door is applied. Although the fabric door can be appended to the tent fabric by any one of a number of well-known means, it is quite commonplace to attach the door to the fabric tent body by one or more zipper arrangements. In addition, oftentimes, tents are provided with a two-ply door having air venting fabric as a first ply and a waterproof fabric as a second ply. Regardless of these details of construction, all such doors are characteristically limited as to orientations which the door can assume as it is opened.

Perhaps the most relevant teaching regarding the present invention can be found in U.S. Pat. No. 5,765,584. The '584 patent teaches a fabric tent having a two-ply door and a "continuous" zipper which defines a C-shaped arcuate path. A pair of zipper slides are mounted on the zipper path such that a pair of consecutively positioned zipper slides unzips the waterproof fabric to allow ventilation through the air-venting fabric when the pair slides towards one another while the waterproof fabric is zipped closed when the pair slides away from each other.

Although the '584 patent offers a certain degree of flexibility, the zipper employed by this reference is not continuous. As such, the tent door is limited in the orientations it can assume. For example, reference is made to FIG. 1 which depicts an embodiment shown in the '584 patent. When zipper slides 47a and 47b are mounted on zipper 41, the door 40 can be opened and closed. Specifically, when the zipper slides 47a and 47b are moved to the opposite tips of the C-shaped arcuate path, the tent door is in a closed position. A motion of the zipper slide 47a in a clockwise direction or a motion of zipper slide 47b in a counter-clockwise direction unzips tent door 40. Conversely, a motion of the zipper slide 47a in a counter-clockwise direction or a motion of the zipper slide 47b in a clockwise direction closes the tent door 40. However, the tent door cannot be fully stashed away for there is a gap between the ends of the zipper where sliders 47a and 47b reside in FIG. 1. Further, door 40, in the illustration made herein, can only open to the left. In the event that it would be more convenient or practical to open the door to the right, the configuration of FIG. 1 would prove inadequate. Finally, as noted previously, if door 40 was to be stashed away, it could not fully be withdrawn from the tent opening in which it resides for the gap between sliders 47a and 47b cannot traverse the open area not occupied by zipper 41. It is deemed to be desirable to be able to join the sliders together to virtually completely withdraw tent door 40 from the tent opening particularly to enhance ventilation and in the event that large objects which have a difficulty in clearing the tent opening must be brought into or withdrawn from the tent's interior volume.

It is thus an object of the present invention to provide a tent which experiences none of the drawbacks as discussed above which are characteristic of prior designs. These and further objects will be more readily appreciated when considering the following disclosure and appended claims.

SUMMARY OF THE INVENTION

The present invention is directed to a tent of the type having a fabric body defining an internal volume and a door for entering and exiting the internal volume and for providing ventilation. The improvement comprises providing a continuous zipper on the door and on the fabric body. A pair of zipper slides are employed for traversing the continuous zipper enabling the door to open in virtually any desired configuration.

DETAILED DESCRIPTION OF THE INVENTION

Figure 1:
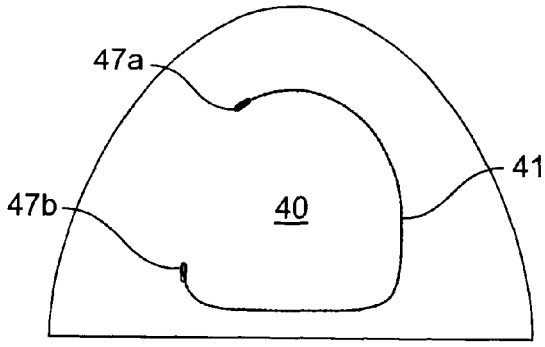
FIG. 1 (PRIOR ART)
FIG. 1 is a schematic representation of the outside view of a tent door of the prior art.
Figure 2:
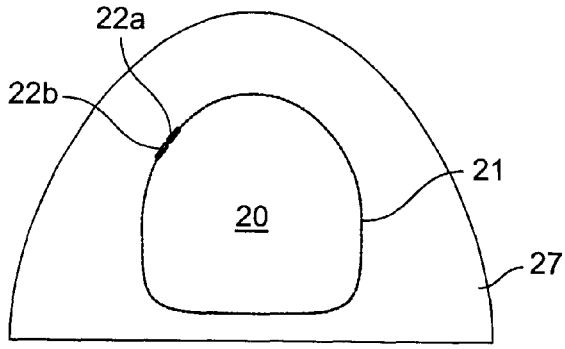
FIG. 2 is a schematic representation of a tent door produced according to the present invention.

As noted previously, FIG. 2 represents a schematic illustration of the present invention. Specifically, fabric tent 27 is shown as having a traditional door 20 enabling a user to enter and exit the tent's internal volume. The present invention, however, differs from prior embodiments in that continuous zipper 21 is provided as a means of attaching door 20 to fabric tent body 27. Along continuous zipper 21 which is shown as defining the peripheral edge of door 20 are located a pair of zipper slides 22*a* and 22*b*. In the orientation shown in FIG. 2, the zipper slides abut in a first position thus completely closing door 20 as the teeth of that portion of the zipper maintained by the door completely mesh with the corresponding teeth of the zipper sewn into tent fabric 27. By employing this configuration, the present invention provides a degree of flexibility as noted with respect to FIGS. 3A, 3B and 4 which are unachievable by similar devices employed in the past.

Figure 3A:
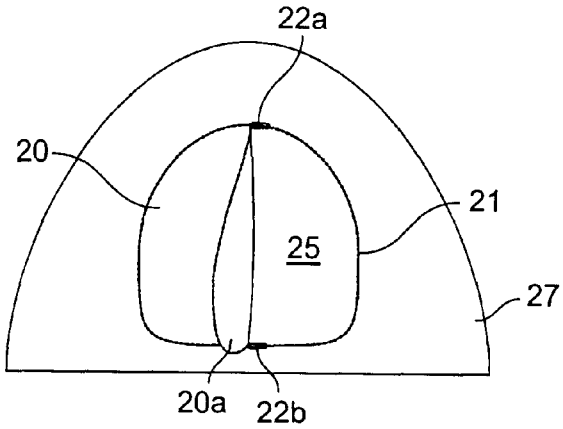
FIGS. 3A and 3B are schematic representations of a tent door which depict the flexibility which the present invention allows in opening the tent door of FIG. 2.
Figure 3B:
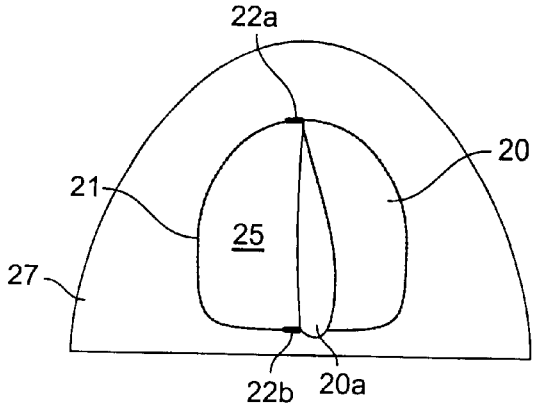

Turning to FIG. 3A, the present invention is shown as door 20 is partially opened such that the door is swung to the left exposing the backside 20*a* of door 20 and exposing internal space 25 created as zipper slides 22*a* and 22*b* reside opposite one another. In turning to FIG. 3B, zipper slides 22*a* and 22*b* have been caused to travel along continuous zipper 21 in the opposite direction exposing internal space 25 of tent 27 as door 20 partially swings to the right exposing its back side, 20*a*. In comparing FIGS. 3A and 3B, it is noted that tent 27 can be made as having a right or left hand door which, as noted previously, is not achievable by the prior art.

Figure 4:
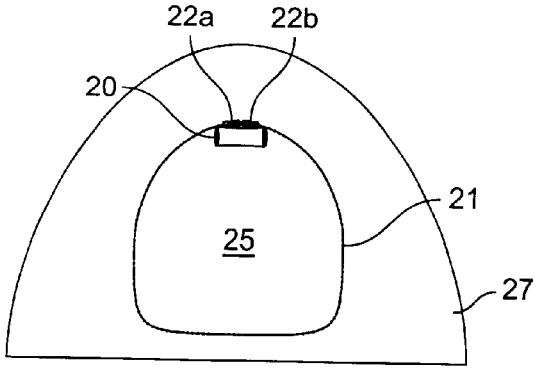
FIG. 4 depicts a schematic view of the tent door of FIG. 2 in a completely opened orientation.
Figure 5A:
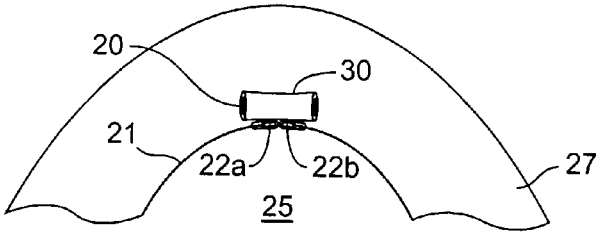
FIGS. 5A and 5B are detailed depictions of two embodiments for storing the tent door once its open orientation as shown in FIG. 4 has been achieved.
Figure 5B:
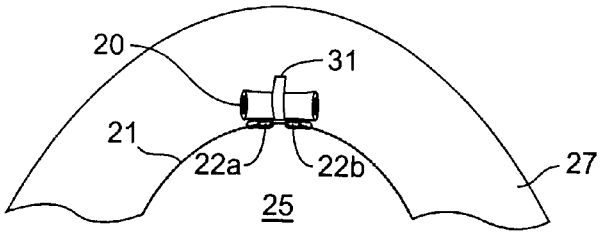

Turning to FIG. 4, internal space 25 is shown to be completely exposed to the tent's opening by moving zipper sliders 22*a* and 22*b* to a second abutting orientation as shown. In such a configuration, tent door 20 can be rolled into a very tight and compact package and stowed any place along continuous zipper 21. FIGS. 5A and 5B show two alternative means for capturing and retaining door 20 when the configuration as depicted in FIG. 4 is desired. For example, pouch 30 can be positioned on tent fabric body 27 proximate the door opening. The tent fabric can be rolled into a tight package and stuffed into pouch 30 which conveniently keeps tent door 20 from in any way obstructing entrance or exit from internal space 25. As an alternative embodiment, once door 20 is compactly rolled, strap 31 sewn to tent fabric 27 can wrap around door 20 employing Velcro® or similar expedient to maintain the strap in place.

As noted previously, various means can be employed for retaining door 20 when the zipper slides abut along zipper 21 to completely open the tent to its interior space 25. These expedients can be appended to tent fabric 27 at any point along zipper 21. In order words, when stowing door 20 as shown in FIG. 4 and FIGS. 5A and 5B, door 20 need not be stowed at the apex of the door opening. Again, such flexibility is unachievable by practicing the prior art.

What is claimed is:

1. In a tent having a fabric body defining an internal volume and a door for entering and exiting said internal volume and for providing ventilation to said internal volume, the improvement comprising providing a continuous zipper on said door and on said fabric body for mating with said continuous zipper on said door and further comprising a pair of zipper slides for traversing said continuous zipper.

2. The tent of claim 1 wherein when said zipper slides abut in a first position, said door is completely closed and when said zipper slides abut in a second position, said door is completely open and when said zipper slides are positioned between said first and second positions, said door is partially open.

3. The tent of claim 2 wherein means are provided on said tent fabric body proximate said door for capturing and retaining said door when said zipper slides are in said second position.

* * * * *